United States Patent [19]

Adams

[11] 4,031,585

[45] June 28, 1977

[54] BINDING OF PERFORATED SHEETS

[75] Inventor: Sidney George William Adams, Hersham, England

[73] Assignee: James Burn Bindings Limited, Esher, England

[22] Filed: Feb. 9, 1976

[21] Appl. No.: 656,158

[30] Foreign Application Priority Data

Feb. 13, 1975 United Kingdom ..... 6178/75

[52] U.S. Cl. ..... 11/1 A; 140/93 D

[51] Int. Cl.² ..... B42C 5/12; B42C 19/00

[58] Field of Search ..... 11/1 A; 140/93 D

[56] References Cited

UNITED STATES PATENTS

| | | | |
|---|---|---|---|
| 3,451,081 | 6/1969 | Liouville | 11/1 A |
| 3,883,916 | 5/1975 | Adams | 11/1 A |

*Primary Examiner*—Lawrence Charles

*Attorney, Agent, or Firm*—Wood, Herron & Evans

[57] ABSTRACT

A machine for binding packets of perforated sheets to book form with wire binding elements each formed from a length of metal wire bent to form a series of curved hairpin-shaped prongs on which the sheets are impaled and which are brought to ring shape by bringing their closed ends or "points" into the vicinity of their open ends or "roots" wherein is provided a reception station for the binding elements which are in the open condition, a binding station at which the perforated sheets are impaled upon the prongs of the elements and the latter are closed, means for conveying the open elements from one station to the other, and a rectifying tool in the form of a wedge-shaped bar arranged for reciprocating into and out from the slot in a binding element characterised in that the wedge head of the bar has its sloping sides either extending at at least two separate angles to the axis and/or lying on at least two separate curves.

7 Claims, 9 Drawing Figures

BINDING OF PERFORATED SHEETS

This invention relates to machines for binding packets of perforated sheets to book form with wire binding elements each formed from a length of metal wire bent to form a series of curved hairpin-shaped prongs on which the sheets are impaled and which are brought to ring shape by bringing their closed ends or "points" into the vicinity of their open ends or "roots". Such machines will be referred to herein as "machines of the kind set forth".

When it is in the condition in which the impaling of the sheets on its prongs is effected, the binding element is in the form of a tube having a slot in its wall extending over its whole length. In that condition, it will be said to be "open"; in its final condition in which the slot is closed, it will be said to be "closed".

One of the difficulties which is encountered in designing binding machines of the kind set forth is the provision of simple means for bringing the binding elements from a source of supply to a binding station and offering them to the sheet impaling prong closing means in the right position and attitude, i.e. with the slot appropriately directed. This is because of the nature of the elements which makes it difficult to handle them mechanically when in the open condition and because of imperfections of shape.

The invention of U.S. Pat. No. 3,451,081 is concerned with a solution of that difficulty.

The invention of that patent comprises a machine of the kind set forth having a reception station for the binding elements coming in the open condition from a source of supply, a binding station at which the perforated sheets are impaled on the prongs of the elements and the latter are closed and means for conveying the open elements from one station to the other characterised in that a rectifying tool is provided and arranged for movement into and out of the slot in a binding element on the magnetised plate, whereby to widen the slot to any desired extent and to correct the shape, position and attitude of the element on the magnetic plate before it is conveyed by the latter from the reception station to the binding station.

In the preferred form of machine in accordance with the invention of U.S. Pat. No. 3,451,081, the rectifying tool is a wedge-shaped bar arranged to be reciprocated normally to the surface of the plate.

In accordance with this invention the wedge head of the bar has its sloping sides either extending at, at least two, and preferably three, separate angles to the axis and or lying on at least two and preferably three separate curves. This has the advantage of enabling several differing sizes to wire binding element to be employed in the machine. For example if the sides of the head are formed at three separate angles then seven differing sizes of binding element may be employed.

An example of a machine in accordance with the invention is shown somewhat diagrammatically in the accompanying drawings, in which.

Figure 1:
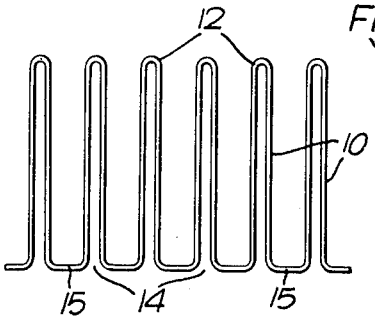
FIG. 1 shows a length of binding material from which binding elements for use in the machine are made.
Figure 2:
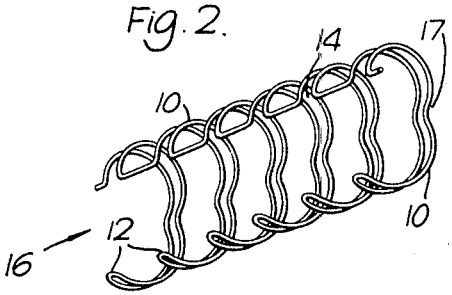
FIG. 2 shows that material bent to the open form in which it is used in the machine.
Figure 4:
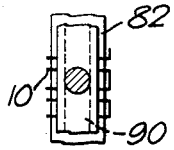
FIG. 4 is a section taken on the line IV—IV in FIG. 3.

FIG. 1 shows a length of steel wire bent to form a band comprising a series of straight hairpin-shaped prongs 10 having closed ends or "points" 12 and open ends or "roots" 14, the prongs at their roots being connected to their neighbours by straight portions 15. To enable such a band to be used for binding packets of perforated sheets to book form, the prongs are brought to the curved shape shown in FIG. 2 in which, in end view, they have two approximately semi-circular poritons giving them the general shape of a FIG. 3. The band is thus converted into a tube having in its wall a longitudinal slot 16 extending over its whole length from which can be cut to form elements for binding packets of perforated sheets, lengths appropriate to the size of the sheets.

The binding operation comprises impaling the perforated sheets on the curved prongs and bringing the points 12 of the prongs into the vicinity of their roots. The latter operation is assisted by the kink 17 in the prongs but the kink is not essential, i.e. the prongs can be C-shaped.

Figure 3:
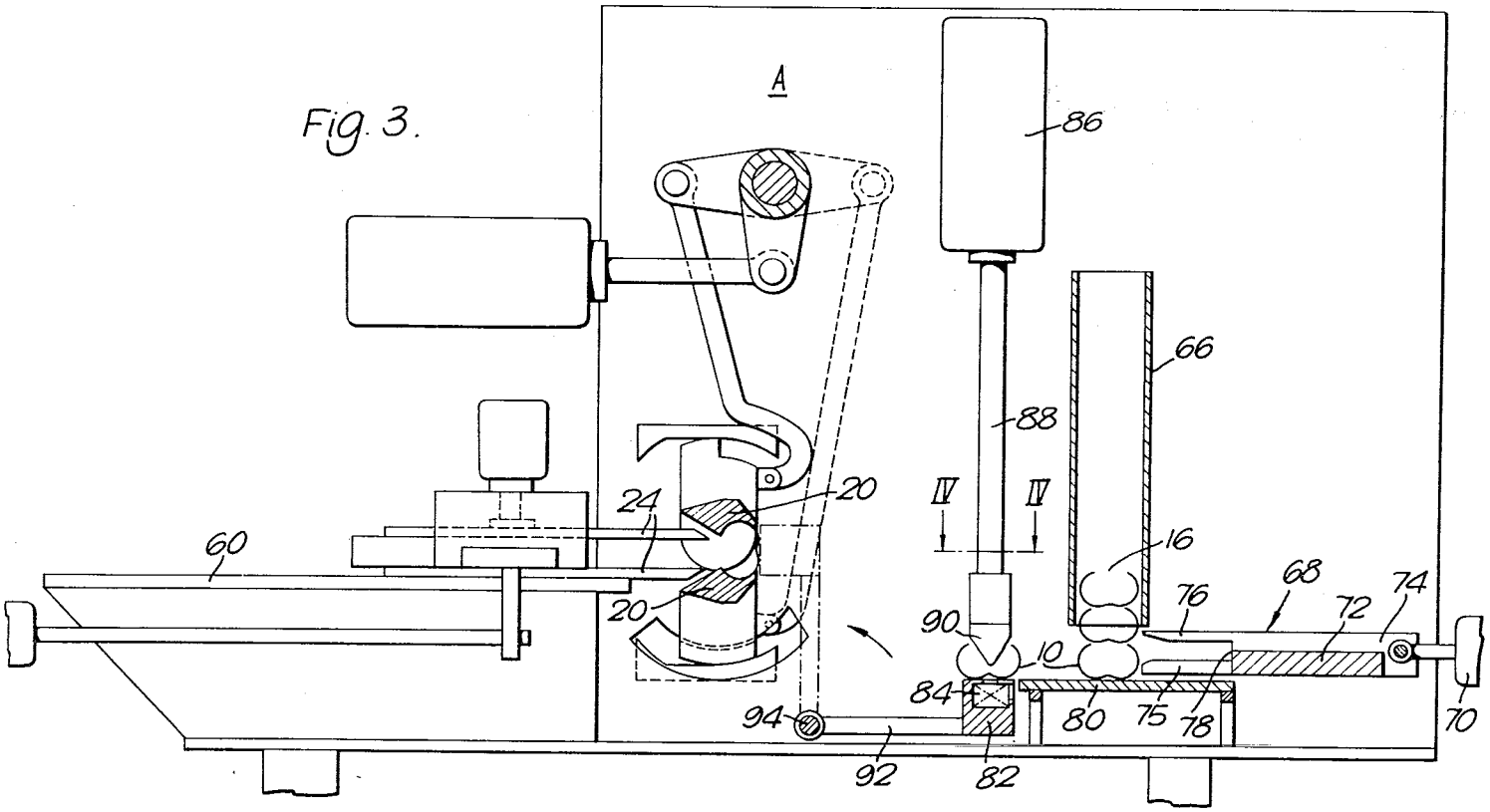
FIG. 3 is an end elevation of the machine.

In the machine shown in FIG. 3, there is a binding station A in which the impaling of the sheets and the closing of the prongs is effected, the packets of sheets (not shown) being fed to it from the left over a table 60 and the binding elements being fed to it from the right.

Figure 5:
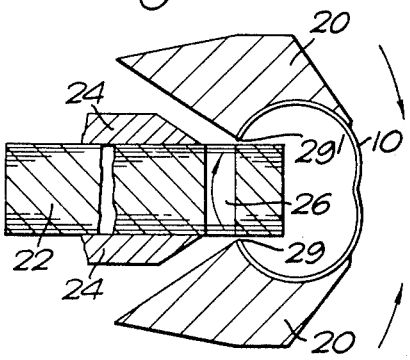
FIGS. 5 and 6 are diagrams illustrating the binding operation.
Figure 6:
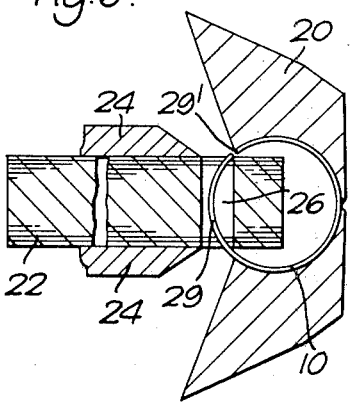

At the binding station there is a pair of closing jaws 20 wherein can be seen a packet of sheets 22 held between clamps 24 with their perforations 26 position for the passage through then of the points 12 of the prongs of a binding element located between the jaws 20. The jaws are mounted for rotation from the position of FIG. 5 to that of FIG. 6 about axes 29 29', this causing the sheets 22 to be impaled on the prongs 10 and the binding element to be closed. The impaling and closing operations are explained in greater detail in the specification of U.S. Pat. No. 3,451,081.

It is important that the binding elements be fed accurately to the closing jaws 20. It will be appreciated that a binding element such as that shown in FIG. 2 needsto be handled with some care if it is not to be distorted. It will also be appreciated that on arrival at the binding machine, a binding element may suffer from various imperfections. Thus, it may have some degree of longitudinal curvature and/or the slot 16 in it may be too narrow to accept the packet of sheets which it is desired to bind. Such imperfections may prevent the impaling and closing jaws performing their allotted functions.

The machine shown in the drawings is provided with simple means which correct such imperfections in the course of conveyance of the binding elements from a source of supply thereof to the binding station.

As shwon in FIG. 3, the source of supply is a magazine 66 in which the binding elements in the open condition are stacked with their slots 16 uppermost. The binding elements are removable therefrom one by one by a pusher 68. Alternatively a continuous strip of binding elements may be supplied as described in the specification of our U.S. Pat. No. 3,883,916.

The pusher 68 has a base plate 72 from which upstand ribs 74 terminating at the left hand end in fingers 75, 76 bevelled at their tips. When the pusher is moved to the left out of the position shown in FIG. 3, its fingers 75, 76 the width of which is slightly smaller than that of the spaces between the prongs 12 of the elements, enter those spaces in repectively the lowermost element and that immediately above it. Continued movement to the left of the pusher causes the shoulder 78 of the base plate to push the lowermost element to the left over the surface of the table 80 and on to a plate 82 with its slot upwards, i.e. remote from the plate.

The engagement of the fingers 75 in the spaces between the prongs of the lowermost element fixes the longitudinal position of the element which is retained in that position when the fingers are withdrawn, by a magnet 84 incorporated in the plate 82. Alternatively the plate 82 may be of magnetic material.

When the lowermost element is moved out of the stack, the element immediately above it drops on to the base plate 72 which supports it at a height which precludes its removal from the magazine. On the return movement of the pusher, the element drops on to the table 80 as shown in FIG. 3.

A binding element having been received by the magnetic plate 82, a jack 86 (FIG. 3) is brought into action to lower a rectifying tool 88 into the upwardly directed slot in the binding element. This tool is a bar of wedge shaped cross section at its lower end 90 which serves to widen the slot to such extent as is required to ensure that it can receive the packet of sheets which it is to bind. The longitudinal position of the element has, as explained above, been fixed by the fingers 75 of the pusher. Its lateral position is adjusted by the rectifying tool which can move the element over the surface of the plate against the yielding resistance of the magnet 84. The rectifying tool also serves to correct distortions (unless they are gross) of the element and generally adjusts and perfects the shape, position and attitude of the element on the magnetic plate to suit requirements at the binding station.

The rectifying tool having been raised, the plate 82, which is carried by an arm 92 pivotally mounted at 94, is swung upwards through 90° by means not shown into the position shown in broken lines in FIG. 3. The element is thus brought to the binding station A in which its prongs are to be passed through the perforations in the packet of sheets to be bound. The manner in which that is effected and details of the mechanism shown in FIG. 3 are described in our U.S. Pat. No. 3,451,081.

Figure 7:
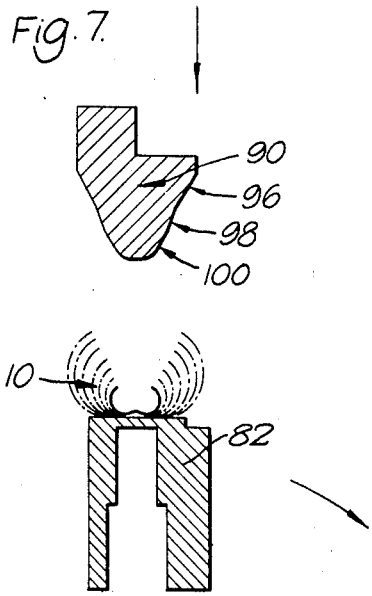
FIGS. 7 and 8 show one embodiment of wedgeshaped bar in accordance with the invention in the nonoperative and operative positions respectively.
Figure 8:
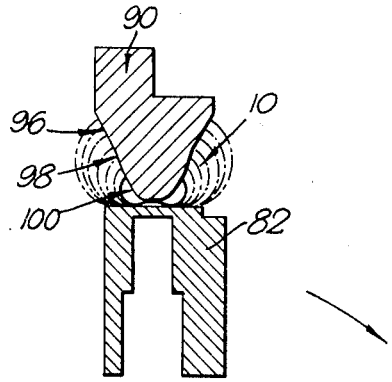

The form of the head of the rectifying tool 90 in accordance with this invention is illustrated in FIGS. 7 and 8. In FIG. 7 the tool is shown in the upper or non-operative position and the sides of its wedge-shaped surfaces are formed of three separate surfaces 96,98 and 100 each extending at a different angle to the vertical. The effect of this as compared with a straight sided wedgeshaped head is that the tool can be used to effect the correct opening of several different sizes of wire binding elements. The machine is therefore not limited to use with only one size of element whereas previously whenever elements of differing sizes were to be used the tool 90 had to be changed.

As can be seen in FIG. 8 the ends of the seven sizes of binding element are contacted by one or other of the different sloping sections of the wedge-shaped head.

As an example the following sizes of wire binding element may be acted upon by a single tool in accordance with this invention, 3/16 inches, ¼ inches, 5/16 inches, ⅜ inches, 7/16 inches, ½ inches and 9/16 inches.

In effect the rectifying tool acts to correct, straighten and align the varying sizes of binding element.

Figure 9:
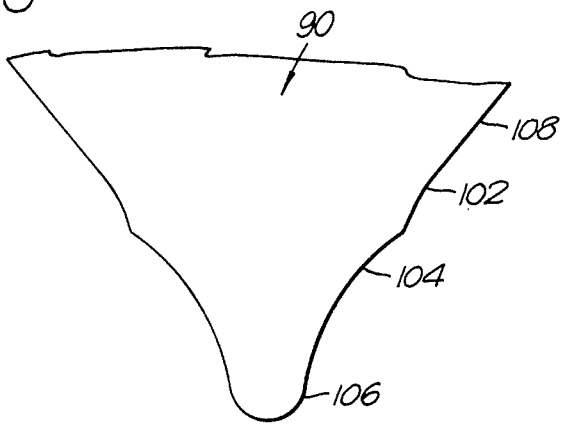
FIG. 9 is a diagrammatic view (to an enlarged scale) of an alternatively profiled wedge-shaped bar.

In the alternative embodiment shown in FIG. 9 the wedge-shaped surfaces of the rectifying tool 90 lie on three separate curves 102, 104, 106 and on one straight line 108, the curve 102 being for example of radius 3mm; the curve 104 being for example of 10.00mm radius and the curve 106 being for example of 1.50mm radius.

Once again the tool can be used to effect the opening of several different sizes of wire binding element, and it has been shown that for small sizes of wire binding element a curved profile tool is more efficient than a straight sided angled bar.

If for example only relatively small sizes of binding element are to be acted on then the whole effective profile of the tool may be on different curves.

I claim:

1. A machine used in binding packets of perforated sheets into book form with wire binding elements, each such element being formed from a length of metal wire bent to form a series of curved hairpin-shaped prongs and having a longitudinal slot from one end thereof to the other, and each element being adapted to receive said sheets in impaled relation prior to closing said element into binding relation with said packet, said machine comprising a rectifying tool in the form of a wedge-shaped bar adapted to reciprocate into and out of the longitudinal slot in each binding element for conforming the shape and position of said element to a perdetermined standard, said wedge-shaped bar having a first side comprised of at least two separate discrete surfaces, said first side surfaces being sized and configured to cooperate with two different size binding elements, and said wedge-shaped bar having a second side comprised of at least two separate discrete surfaces, said second side surfaces also being sized and configured to cooperate with two different size binding elements, one of said first side surfaces and one of said second side surfaces cooperating to conform the shape and position of a first size binding element, and the other of said first side surfaces and one of said second side surfaces cooperating to conform the shape and position of a second size binding element.

2. A machine as set forth in claim 1 in which said surfaces are selected from the group consisting of linear and curvilinear surfaces.

3. A machine as set forth in claim 2 in which said surfaces are all linear.

4. A machine as set forth in claim 2 in which said surfaces are all curvilinear.

5. A machine as set forth in claim 2 in which at least three separate discrete surfaces are provided on at least one side of said wedge-shaped bar.

6. A machine as set forth in claim 2 in which curvilinear surfaces on each side are identical one to another, but in mirror relation relative to a center plane of said wedge-shaped bar, one of said curvilinear surfaces on each side having a radius of 10.00 mm and the other of said curvilinear surfaces on each side having a radius of 1.50 mm.

7. A machine as set forth in claim 1 including a magnetic support surface on which each binding element is adapted to be independently received, said support surface magnetically restraining each binding element in supporting relation therewith in that position that permits reciprocation of said wedge-shaped bar into and out of said longitudinal slot of said binding element for conforming that element so supported.

* * * * *